US007488887B2

(12) United States Patent
Mori

(10) Patent No.: US 7,488,887 B2
(45) Date of Patent: Feb. 10, 2009

(54) PERCUSSION-INSTRUMENT PICKUP AND ELECTRIC PERCUSSION INSTRUMENT

(75) Inventor: Yasuhiko Mori, Tokyo (JP)

(73) Assignee: Korg Inc., Tokyo (JP)

( * ) Notice: Subject to any disclaimer, the term of this patent is extended or adjusted under 35 U.S.C. 154(b) by 0 days.

(21) Appl. No.: 11/642,048

(22) Filed: Dec. 18, 2006

(65) Prior Publication Data

US 2007/0137460 A1 Jun. 21, 2007

(30) Foreign Application Priority Data

Dec. 19, 2005 (JP) ..... 2005-364406

(51) Int. Cl.
*G10H 1/32* (2006.01)
*G10H 3/00* (2006.01)

(52) U.S. Cl. ..... 84/743; 84/723

(58) Field of Classification Search ..... 84/723, 84/274

See application file for complete search history.

(56) References Cited

U.S. PATENT DOCUMENTS

| | | | | | |
|---|---|---|---|---|---|
| 3,008,367 | A * | 11/1961 | Parsons | 84/725 |
| 3,725,561 | A * | 4/1973 | Paul | 84/726 |
| 4,149,444 | A * | 4/1979 | Parsons | 84/404 |
| 4,168,646 | A * | 9/1979 | May | 84/723 |
| 4,200,025 | A * | 4/1980 | Currier | 84/422.1 |
| 4,226,156 | A * | 10/1980 | Hyakutake | 84/730 |
| 4,233,836 | A * | 11/1980 | Yoneda et al. | 73/35.03 |
| 4,242,937 | A * | 1/1981 | Pozar | 84/725 |
| 4,570,522 | A * | 2/1986 | May | 84/723 |
| 4,744,279 | A * | 5/1988 | Livingston | 84/746 |
| 4,817,485 | A * | 4/1989 | Bozzio et al. | 84/746 |
| 5,042,356 | A * | 8/1991 | Karch | 84/725 |
| 5,325,718 | A * | 7/1994 | Ono | 73/654 |
| 5,342,989 | A * | 8/1994 | Barcus | 84/730 |
| 5,345,037 | A * | 9/1994 | Nordelius | 84/730 |
| 5,585,581 | A * | 12/1996 | Rogers | 84/414 |
| 5,602,354 | A * | 2/1997 | Martin | 84/410 |
| 5,965,834 | A * | 10/1999 | Suenaga et al. | 84/422.3 |
| 5,977,473 | A * | 11/1999 | Adinolfi | 84/723 |
| 6,295,870 | B1 * | 10/2001 | Hulsing, II | 73/514.37 |
| 6,321,599 | B2 * | 11/2001 | Takeuchi et al. | 73/504.02 |
| 6,794,569 | B2 * | 9/2004 | Kamijima et al. | 84/746 |
| 6,815,602 | B2 * | 11/2004 | De Franco | 84/730 |
| 6,881,885 | B2 * | 4/2005 | Yoshino et al. | 84/402 |
| 6,979,770 | B2 * | 12/2005 | Hampton, Jr. | 84/723 |

(Continued)

FOREIGN PATENT DOCUMENTS

| | | |
|---|---|---|
| JP | 11-184459 | 7/1999 |

(Continued)

*Primary Examiner*—Walter Benson
*Assistant Examiner*—Robert W Horn
(74) *Attorney, Agent, or Firm*—David N. Lathrop, Esq.; Gallagher & Lathrop

(57) ABSTRACT

An attachment part is disposed on a part of the edge of a resonance plate, which is made of a metal containing copper, and a weight is attached to the resonance plate at a predetermined distance from the attachment part. Plural vibration pickups are attached to the surface of the resonance plate between the weight and the attachment part. The resonance plate is attached to a percussion instrument at the attachment part. The plural vibration pickups produce electric signals corresponding to the resonant vibrations at their respective positions on the resonance plate, and the electric signals are mixed and output as percussion-instrument-sound signals.

16 Claims, 17 Drawing Sheets

U.S. PATENT DOCUMENTS

| | | | | |
|---|---|---|---|---|
| 7,034,218 | B1 * | 4/2006 | Lazarus et al. | 84/723 |
| 7,196,261 | B2 * | 3/2007 | Suenaga | 84/730 |
| 7,259,317 | B2 * | 8/2007 | Hsien | 84/723 |
| 7,294,778 | B2 * | 11/2007 | Susami | 84/723 |
| 7,297,863 | B2 * | 11/2007 | May | 84/723 |
| 2003/0200860 | A1 * | 10/2003 | Toda | 84/746 |
| 2006/0021495 | A1 * | 2/2006 | Freitas | 84/723 |
| 2007/0137460 | A1 * | 6/2007 | Mori | 84/421 |

FOREIGN PATENT DOCUMENTS

| | | |
|---|---|---|
| JP | 11-237877 | 8/1999 |
| WO | WO-02/21504 A1 | 3/2002 |

* cited by examiner

PERCUSSION-INSTRUMENT PICKUP AND ELECTRIC PERCUSSION INSTRUMENT

BACKGROUND OF THE INVENTION

1. Field of the Invention

The present invention relates to a percussion-instrument pickup suitable for a variety of percussion instruments, such as a drum and a cymbal, and an electric percussion instrument that incorporates the percussion-instrument pickup.

2. Description of the Related Art

The applicant has proposed an electric snare drum having a wire gauze as a drumhead and a loudspeaker device for the electric snare drum, as disclosed in the patent literature 1 (Japanese Patent Application Laid-Open No. 11-237877).

The previously proposed electric snare drum has a wire gauze as the drumhead, so that the drumhead produces no sound if it is hit actually. Therefore, the electric snare drum is suitable for practice. The electric snare drum, which actually produces no sound, has a vibration pickup. Users of the electric snare drum can hear the sounds converted from the electric signals picked up by the vibration pickup through headphones and thus can avoid annoying those around them. Therefore, the electric snare drum is suitable for practice. In addition, if the electric signals picked up by the vibration pickup are output as sounds by a laud-speaker device, the electric snare drum can be used for live stage performance.

In addition, the applicant has proposed a muffled cymbal composed of a metal plate having multiple pores that absorb the acoustic energy produced when it is hit, thereby achieving sound attenuation, and an electric cymbal that is formed by attaching a vibration pickup to the muffled cymbal and produces sound converted from the electric signals picked up by the vibration pickup, as disclosed in the Patent literature 2 (Japanese Patent Application Laid-Open No. 11-184459).

The previously proposed muffled cymbal produces a sound changing depending on the point of hitting, the strength of hitting, the kind of the stick and the like. In this regard, the muffled cymbal is equivalent to the acoustic cymbal. In addition, the muffled cymbal has the sound attenuation capability. Thus, the muffled cymbal has optimal characteristics as a cymbal used for practice.

The electric snare drum previously proposed has the vibration pickup attached to the body, and vibrations of the body are converted into electric signals, thereby producing drum-sound signals. If the drum-sound signals are reproduced as sound, the tone is significantly affected by the waveform of the resonance of the body and thus slightly differs from that of the sound of acoustic drums.

In addition, the electric cymbal previously proposed has the vibration pickup attached directly to the backside of the cup of a cymbal, which is located substantially at the center of the cymbal, and the vibration pickup converts the vibrations of the cup into electric signals.

Thus, the electric cymbal has a disadvantage that it produces a sound containing much of the sound of vibrations of the cup, and the vibration pickup does not detect the sound of the whole cymbal. Generally, cymbals can produce sounds rich in higher-frequency components or lower-frequency components depending on the diameter thereof. However, if the vibration pickup detects the vibrations of the cup, the sound reproduced from the detection signals does not depend on the diameter of the cymbal but is affected by the shape of the cup or the like.

Furthermore, the electric drum proposed in the patent literature 1, which has a wire gauze as the drumhead, has a disadvantage that the wire gauze is deformed, or caves in, if the drumhead is hit hard. In addition, since the wire gauze is composed of wires woven perpendicularly to each other, the wire gauze is highly resistant to tensile forces in directions of the wires but less resistant to tensile forces in oblique directions. Thus, the electric drum has another advantage that the drum-sound signals produced by the vibration pickup change depending on the relationship between the point of hitting and the position of the vibration pickup, thereby changing the strength or tone of the produced drum sound.

SUMMARY OF THE INVENTION

An object of the present invention is to provide a percussion-instrument pickup that enables reproduction of a drum sound extremely resembling that of an acoustic drum and reproduction of a cymbal sound extremely resembling that of an acoustic cymbal, and an electric percussion instrument incorporating the percussion-instrument pickup.

Another object of the present invention is to provide an electric percussion instrument (electric drum) that avoids deformation of a drumhead even if the drumhead is hit hard and does not change the strength of the drum-sound signal or the tone thereof depending on the hitting point.

According to a first aspect of the present invention, there is provided a percussion-instrument pickup, comprising: a resonance plate that is made of a metal containing at least copper and has an area smaller than the area of a hitting surface of a percussion instrument to which the percussion-instrument pickup is attached; a weight attached to a part of the perimeter of the resonance plate; an attachment part disposed at a predetermined distance from the point of attachment of the weight; and a plurality of vibration pickups attached to the surface of the resonance plate between the attachment part and the weight.

In the first aspect, preferably, the resonance plate has a substantially rectangular shape, the longer side thereof being shorter than the diameter of the hitting surface of the percussion instrument to which the percussion-instrument pickup is attached, the weight being attached to one of the shorter sides thereof, and the attachment part being disposed at the other shorter side, and the plurality of vibration pickups are attached to the surface of the resonance plate between the attachment part and the point of attachment of the weight.

In the first aspect, preferably, the resonance plate has one or more notches formed in an edge thereof, the one or more notches divide the resonance plate into a plurality of resonance elements, and each of the plurality of resonance elements has a vibration pickup attached thereto.

According to a second aspect of the present invention, there is provided a percussion-instrument pickup, comprising: an L-shaped supporting part that is bent in an L shape, the part between an angled edge formed by the bend and one tip end of the L-shaped supporting part serving as an attachment part, the attachment part being attached to and along an attachment surface, and a protruding end part of the supporting part on the opposite side of the angled edge to the attachment part being supported by the attachment part and protruding from the attachment surface; a resonance plate that is made of a metal containing at least copper, one of the ends of the resonance plate being connected to the protruding end part of the L-shaped supporting part that protrudes from the attachment part, the other end thereof being in pressure contact with an extension of the attachment surface, and the resonance plate being excited at the point of pressure contact by a vibration transferred to the extension of the attachment surface; and a plurality of vibration pickups attached to the surface of the resonance plate.

According to a third aspect of the present invention, there is provided an electric percussion instrument that comprises a cylindrical body and a drumhead attached over an open end of the cylindrical body and produces a drum sound when the drumhead is hit, in which the electric percussion instrument further comprises the percussion-instrument pickup described above, and the resonance plate of the percussion-instrument pickup is attached to the inner wall of the body via the attachment part in a cantilever configuration, the resonance plate supported in the cantilever configuration is excited by a vibration of the body, and the vibration pickups attached to the resonance plate produce drum-sound signals from the resonance of the resonance plate.

In the third aspect, preferably, a part of the resonance plate of the percussion-instrument pickup is in contact with the drumhead in the vicinity of the joint between the drumhead and the body, and the resonance plate is supplied with excitation energy from both the body and the drumhead.

In the third aspect, preferably, the drumhead is composed of a perforated polymeric resin film that has pores formed therein with an opening ratio of about 20 to 45%. More preferably, the pores formed in the drumhead are arranged in a 60-degree staggered pattern.

According to a fourth aspect of the present invention, there is provided an electric percussion instrument, comprising: a cymbal that is composed of a disk-like metal plate and has a protruding cup at the center thereof, a bow surrounding the cup, and an edge surrounding the bow; and the percussion-instrument pickup described above, in which the attachment part of the resonance plate of the percussion-instrument pickup is attached to the backside of the cup, the resonance plate of the percussion-instrument pickup is excited by a vibration of the cup, and the vibration pickups produce electric signals having a waveform corresponding to the sound of the cymbal.

In the fourth aspect, preferably, multiple pores are formed in the bow and edge of the cymbal.

In the percussion-instrument pickup according to the present invention described above, the resonance frequency of the resonance plate can be arbitrarily set by appropriately determining the shape, including the length, of the resonance plate, the weight of the weight or the like. As a result, the quality of the sound produced is determined mainly based on the resonance frequency of the resonance plate and the waveform of the resonant vibration, without being significantly affected by the quality of the sound of the percussion instrument to which the percussion-instrument pickup is attached. Since the resonance plate is made of copper or a metal containing copper, the deep tones specific to the coppery percussion instrument can be reproduced.

In addition, since the resonance plate has one or more notches, the one or more notches divide the resonance plate into a plurality of resonance elements, and each of the plurality of resonance elements has a vibration pickup attached thereto, a vibration waveform, which is a sum of the resonant vibrations of the resonance elements, can be provided. Thus, hitting-sound signals distributed over a wide range of frequency spectra can be produced, so that a percussion-instrument sound that is rich in tone and contains many harmonic components can be produced.

The percussion-instrument pickup according to the present invention can be attached to a wide variety of percussion instruments, including various acoustic drums and acoustic cymbals. If the percussion-instrument pickup is attached to an acoustic drum, the drum sound can be output from a loudspeaker device without using a microphone. Alternatively, if the percussion-instrument pickup is used with an acoustic cymbal, the cymbal sound can be output from a loudspeaker device. In the case where the percussion-instrument pickup according to the present invention is used with such various acoustic percussion instruments, the hitting sounds reproduced by the loudspeaker device extremely resemble the original hitting sounds of the respective acoustic percussion instruments.

In addition, even if the percussion-instrument pickup according to the present invention is used with the muffled drum disclosed in the patent literature 1 or the muffled cymbal disclosed in the patent literature 2, the hitting sound reproduced by the loudspeaker device extremely resemble the sound of the acoustic drum or acoustic cymbal.

DETAILED DESCRIPTION OF THE PREFERRED EMBODIMENT

In the following, preferred embodiments of the present invention will be described.

First, a rectangular metal plate is prepared. The material of the metal plate contains at least copper and is brass, for example. The metal plate is used as a resonance plate. In the case where the percussion instrument to be equipped with the metal plate is a drum, the rectangular metal plate is dimensioned so that the longer side thereof is shorter than the diameter of the drumhead. In the case where the percussion instrument to be equipped with the metal plate is a cymbal, the rectangular metal plate is dimensioned so that the longer side thereof is shorter than the diameter of the cymbal.

The rectangular metal plate has an attachment part for attachment to the relevant percussion instrument in the vicinity of one of the shorter sides thereof and a weight in the vicinity of the other shorter side. Since the resonance plate is attached to the percussion instrument by the attachment part close to one shorter side thereof, the resonance plate is supported on the percussion instrument in a cantilever configuration and thus is excited by and vibrates in resonance with the vibration transferred to the attachment part. The weight is preferably made of the same material as the resonance plate.

A plurality of vibration pickups are attached to the surface of the resonance plate between the weight and the attachment part and convert resonant vibrations at their respective points on the resonance plate into electric signals. The electric signals are mixed and output as hitting-sound signals.

As an alternative structure of the resonance plate, one or more notches may be formed in an edge of the resonance plate, thereby making parts of the resonance plate separated from each other by the one or more notches function as independent resonance elements. If the independent resonance elements have their respective vibration pickups, electric signals containing more various frequency spectra can be produced, and the sound quality of the percussion instrument can be improved.

First Embodiment

Figure 1:
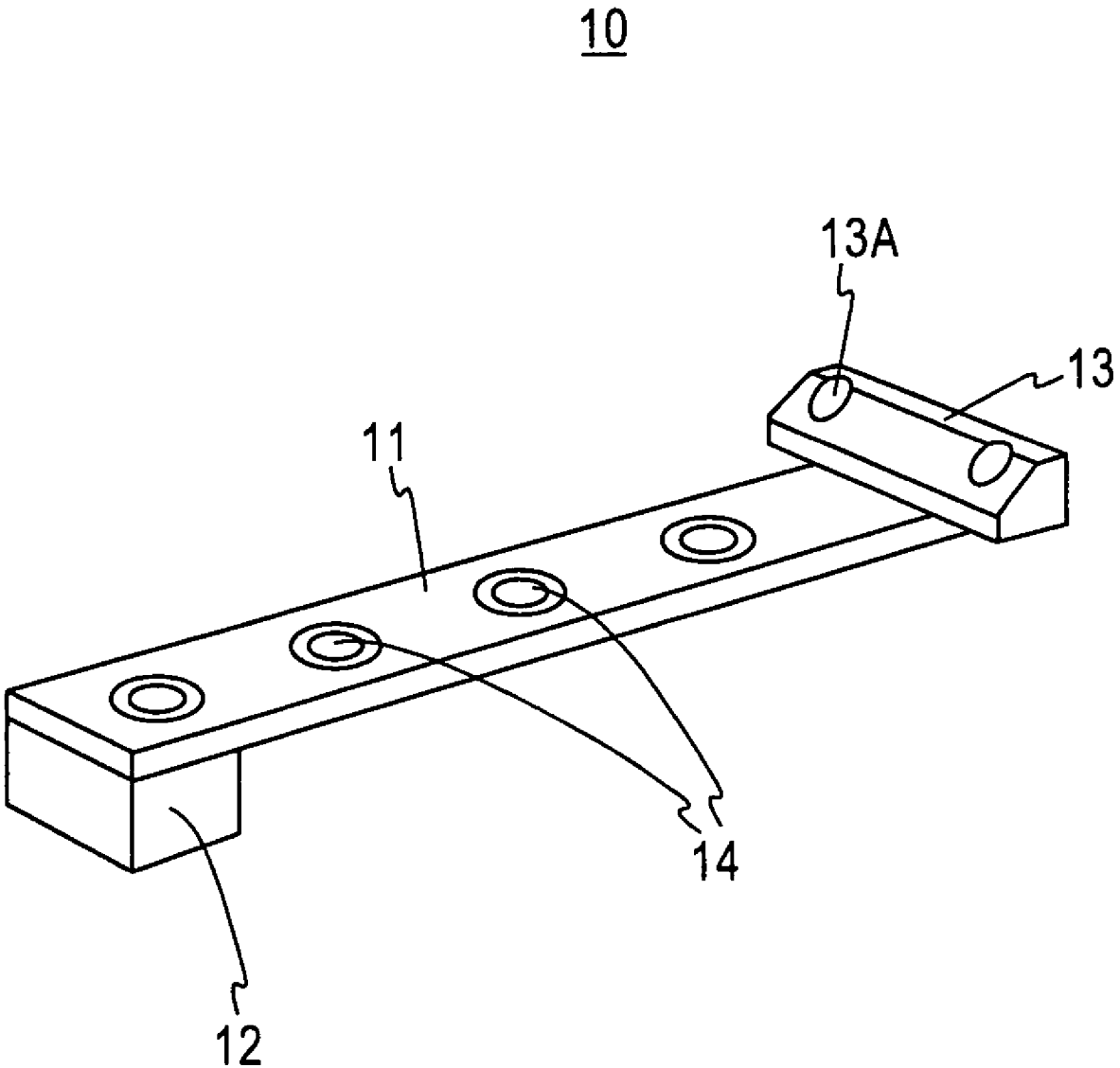
FIG. 1 is a perspective view for illustrating a percussion-instrument pickup according to an embodiment of the present invention.

FIG. 1 shows a percussion-instrument pickup according to a first embodiment of the present invention. A percussion-instrument pickup 10 according to this embodiment is a drum pickup.

The percussion-instrument pickup 10 shown in this drawing comprises a rectangular resonance plate 11, a weight 12 attached to the resonance plate 11 at a position close to one of the shorter sides thereof, an attachment part 13 provided on the resonance plate 11 at a position close to the other shorter side thereof, and a vibration pickup 14 attached to the surface of the resonance plate 11 between the positions of the weight and the attachment part 13.

As described above, the resonance plate 11 is composed of a metal plate containing at least copper, such as brass. The resonance plate 11 is dimensioned so that the longer side thereof is shorter than the diameter of a drumhead of a drum, to which the resonance plate 11 is attached. The resonance plate 11 has a thickness of approximately 1.0 to 2.0 mm. The weight 12 is preferably composed of a metal block of the same material as the resonance plate 11. This arrangement in synergy with the material (metal containing copper) of the resonance plate 11 allows appropriate resonant vibration of the resonance plate 11, so that high-quality hitting-sound signals can be obtained.

The vibration pickup 14 may be a piezoelectric element. A plurality of vibration pickups 14 are attached to the surface of the resonance plate 11 at different points between the weight 12 and the attachment part 13. The vibration pickups 14 are connected in series or in parallel, and the detection signals of the vibration pickups 14 are mixed before being output.

The attachment part 13 according to this embodiment is a reinforcing member having a screw hole 13A attached to the resonance plate 11 at a position close to one end thereof. The end of the resonance plate 11 is secured to the body of the drum with a screw passing through the screw hole 13A in the reinforcing member.

Figure 2:
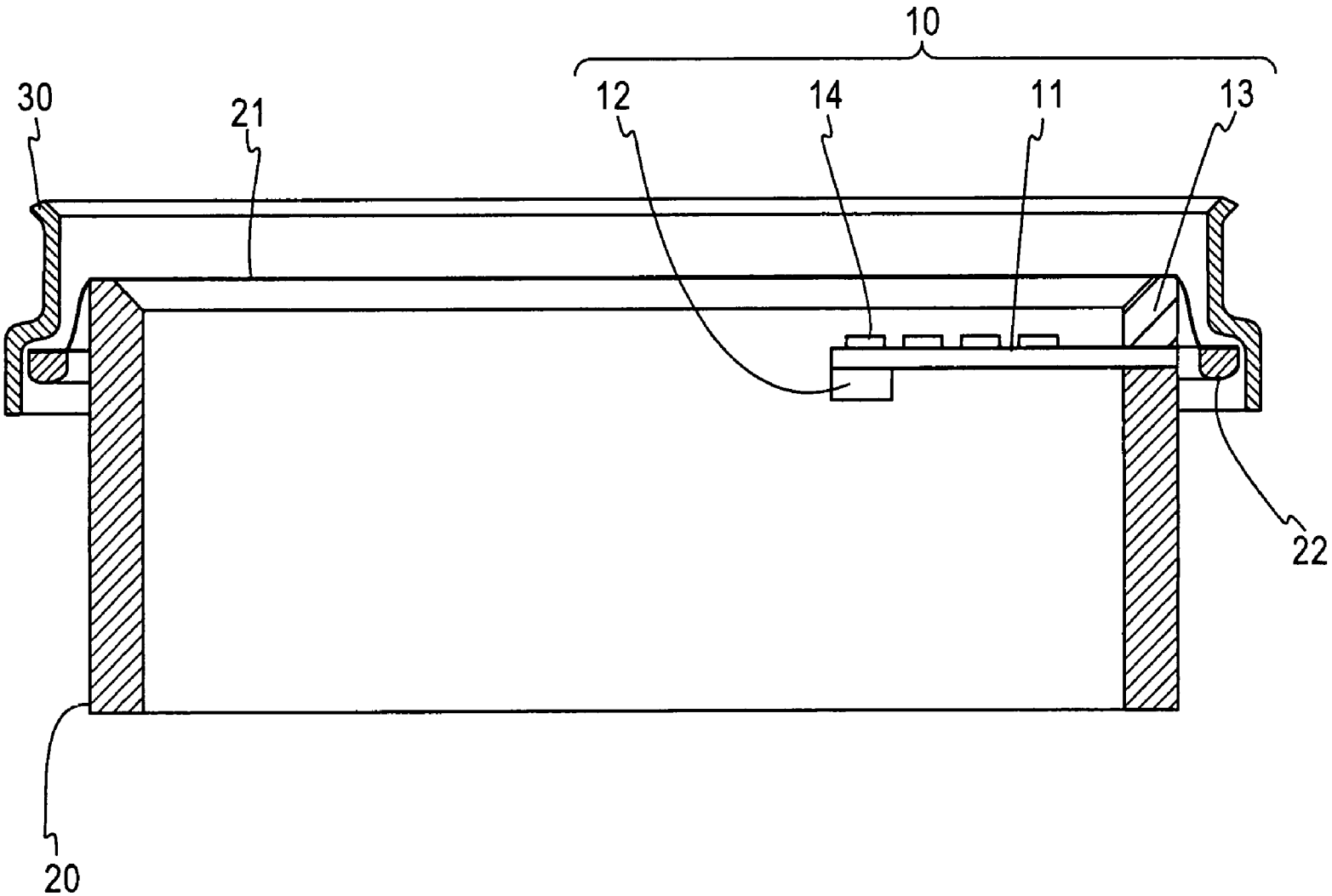
FIG. 2 is a cross-sectional view for illustrating an example of an electric drum composed of a drum and the percussion-instrument pickup shown in FIG. 1 attached thereto.

FIG. 2 shows the percussion-instrument pickup 10 shown in FIG. 1 attached to a drum. As well known, the drum comprises a cylindrical body 20 and a drumhead 21 made of a hide or polymeric resin sheet stretched over each open end of the cylindrical body 20 and fixed thereto. In the example shown in FIG. 2, the drumhead 21 is stretched over only one of the open end of the body 20.

A ring 22 is disposed around the perimeter of the drumhead 21 to keep the drumhead 21 stretched over the open end of the body 20. That is, a rim 30 presses the ring 22 downward, and the pressing force produces a tensile force on the drumhead 21. Here, in FIG. 2, a mechanism for pressing the rim 30 downward, such as a tension bolt, is omitted.

A notch is formed in the edge of the open end of the body 20. The attachment part 13 is housed in the notch and fixed to the open end of the body 20 by a wood screw or the like fitted into the screw hole 13A (FIG. 1), thereby fixing the percussion-instrument pickup 10 to the body 20 of the drum.

Once the attached to the body 20 of the drum, the resonance plate 11 of the percussion-instrument pickup 10 is supported on the body 20 in a cantilever configuration. When the drumhead 21 is hit, the sound pressure is directly applied to the resonance plate 11 from the drumhead 21, and in addition, the vibration is transferred to the resonance plate 11 via the body 20. Then, the resonance plate 11 vibrates at a resonance frequency determined by the length and thickness of the resonance plate 11, the weight of the weight 12, and the like. The vibration pickup 14 detects the vibration and produces a hitting-sound signal. The hitting-sound signal varies with the resonance frequency of the resonance plate 11, and the sound of the acoustic drum can be reproduced by appropriately setting the resonance frequency of the resonance plate 11.

In this embodiment shown in FIG. 1, the resonance plate 11 has a rectangular shape. However, the shape of the resonance plate 11 according to the present invention is not limited to the rectangle. The resonance plate 11 may be an elliptical or circular one with the attachment part 13 protruding from the perimeter thereof. The tone can be changed in various ways by changing the shape of the resonance plate 11 and the weight of the weight 12.

Second Embodiment

Figure 3:
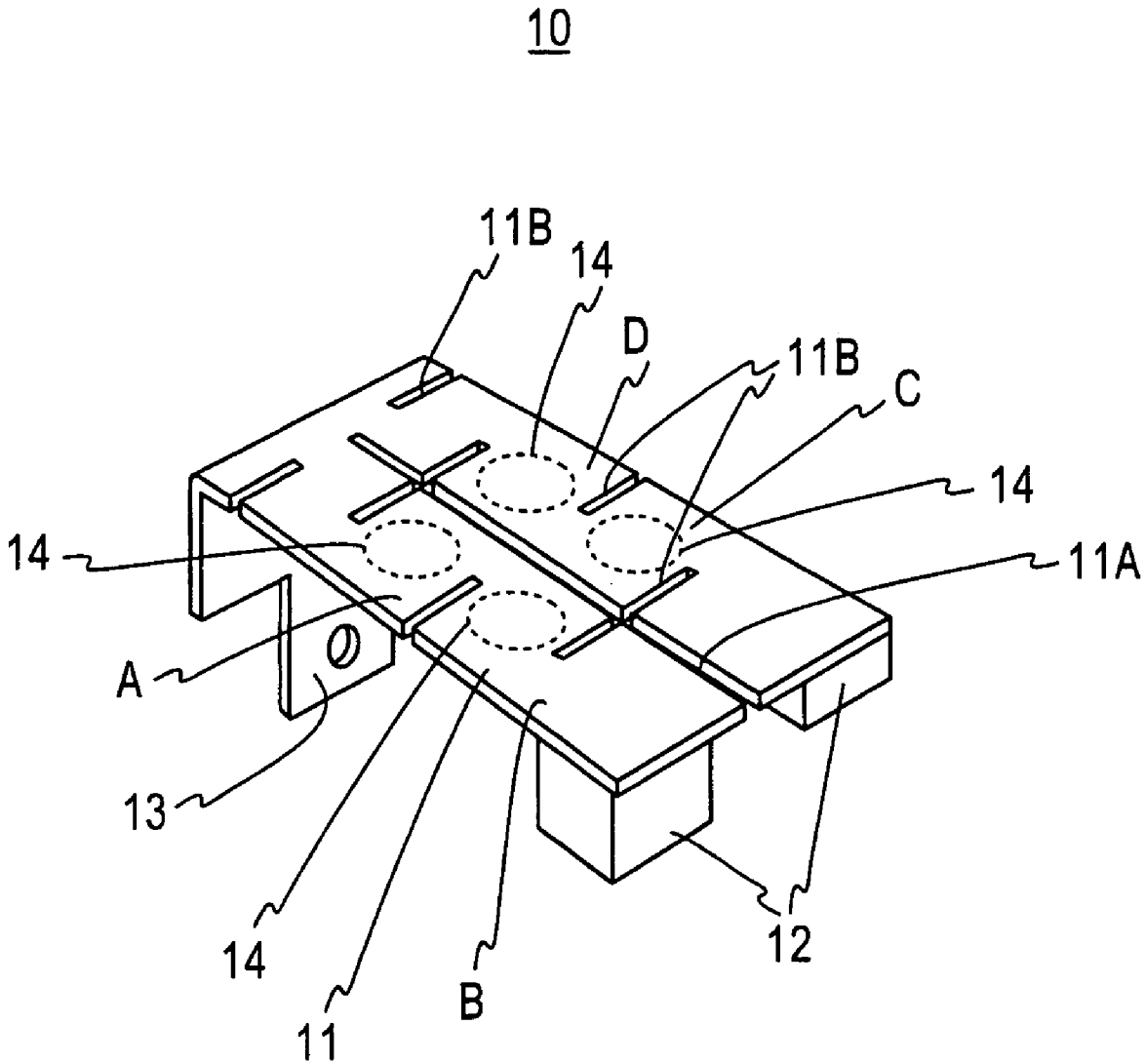
FIG. 3 is a perspective view for illustrating a percussion-instrument pickup according to another embodiment of the present invention.

FIG. 3 shows a percussion-instrument pickup 10 according to a second embodiment of the present invention. According to this embodiment, a resonance plate 11 has notches formed in edges thereof, thereby forming a plurality of resonance elements separated by the notches, and the resonance elements have their respective vibration pickups 14 to convert their respective vibrations into electric signals. Although a single notch or a plurality of notches may be formed, an example in which a plurality of notches are formed will be described in the following.

In the embodiment shown in FIG. 3, a notch 11A extends in parallel with the longer sides of the resonance plate 11, and notches 11B extend in parallel with the shorter sides of the resonance plate 11. The notches define a plurality of resonance elements A, B, C and D, and each of the resonance elements A to D has its own vibration pickup 14.

Two resonance-plate parts separated by the notch 11A have weights 12 of different weights attached to the respective free ends and thus have different resonance frequencies. In addition, the notches 11B have different lengths and are appropriately displaced from each other, thereby making the resonance frequency of the resonance elements A to D different. As a result, the electric signals produced by the vibrations pickups 14 attached to the resonance elements A to D contain a wide variety of frequency spectra, and thus, the sound of the acoustic drum can be reproduced.

The percussion-instrument pickup 10 shown in FIG. 3 can be supported in a cantilever configuration in which the resonance plate 11 is bent at a point close to the attachment part 13, and the attachment part 13 is attached to a wall.

Figure 4:
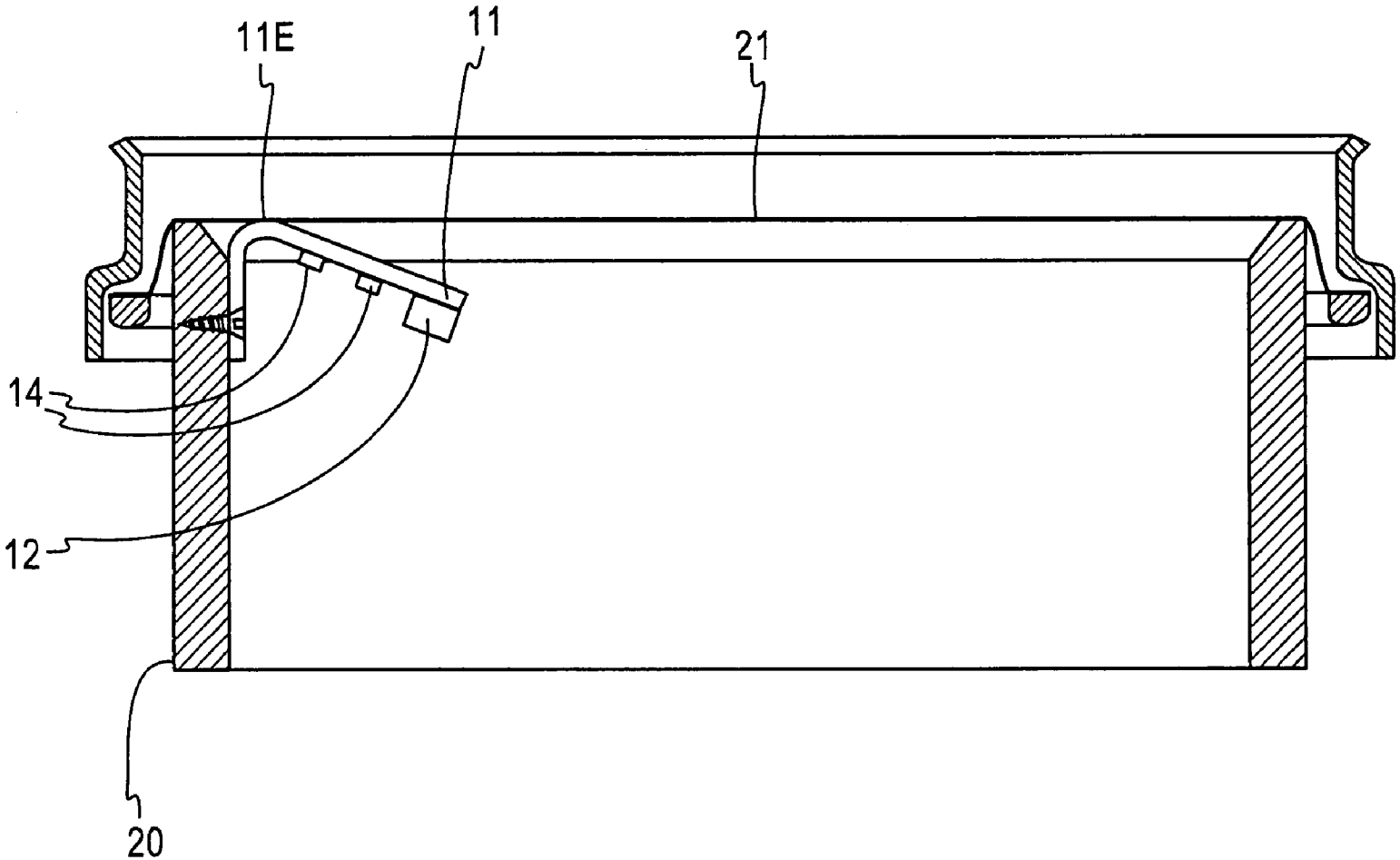
FIG. 4 is a cross-sectional view for illustrating an example of an electric drum composed of a drum and the percussion-instrument pickup shown in FIG. 3 attached thereto.

FIG. 4 shows an example of attachment of the percussion-instrument pickup 10 shown in FIG. 3. In the example shown in FIG. 4, the resonance plate 11 is bent at an acute angle at a point between the attachment part 13 and the vibration pickups 14, the attachment part 13 is attached to the inner wall of a body 20 of a drum, a curved surface 11E of the bend is in contact with the backside of a drumhead 21, and the resonance plate 11, which is in contact with the backside of the drumhead 21 at the bend, gradually diverges therefrom as it extends toward the center of the body 20.

Since the percussion-instrument pickup 10 is attached as shown in FIG. 4, the resonance plate 11 does not come into contact with the part of the drumhead 21 that vibrates strongly but come into contact with the part of the drumhead near a node of the vibration of the drumhead 21. As a result, the contact of the resonance plate 11 with the drumhead 21 does not have a significant effect on the vibration of the drumhead 21, and the resonance plate 11 can be excited with high excitation energy because the resonance plate 11 is in contact with the part of the drumhead 21 near a node, at which the vibration energy is high. In addition, the resonance plate 11 can be supplied with excitation energy also from the body 20.

Third Embodiment

Figure 5:
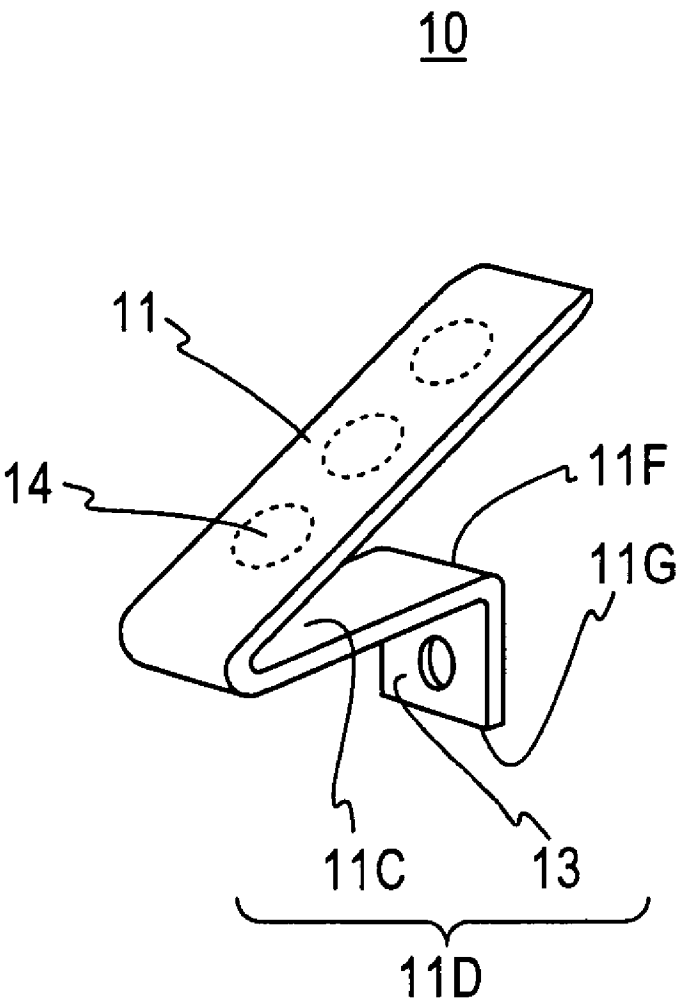
FIG. 5 is a perspective view for illustrating a percussion-instrument pickup according to another embodiment of the present invention.

FIG. 5 shows a percussion-instrument pickup 10 according to a third embodiment of the present invention. In this embodiment, the percussion-instrument pickup comprises: an L-shaped supporting part 11D that is bent in an L shape, the part between an angled edge 11F formed by the bend and one tip end 11G of the L-shaped supporting part 11D serving as an attachment part 13, the attachment part 13 being attached to and along an attachment surface, and a protruding end part 11C of the supporting part 11D on the opposite side of the angled edge 11F to the attachment part 13 being supported by the attachment part 13 and protruding from the attachment surface; a resonance plate 11 that has one end connected to the protruding end part 11C of the L-shaped supporting part 11D and the other end in pressure contact with an extension of the attachment surface and is excited at the point of pressure contact by the vibration transferred to the extension of the attachment surface; and a plurality of vibration pickups 14 attached to the surface of the resonance plate 11.

In the embodiment shown in FIG. 5, the resonance plate 11 and the L-shaped supporting part 11D are formed as a single piece. However, according to the present invention, it is essential only that at least the resonance plate 11 is made of a material containing at least copper, such as brass. Therefore, the L-shaped supporting part 11D may be made of other metal materials.

Figure 6:
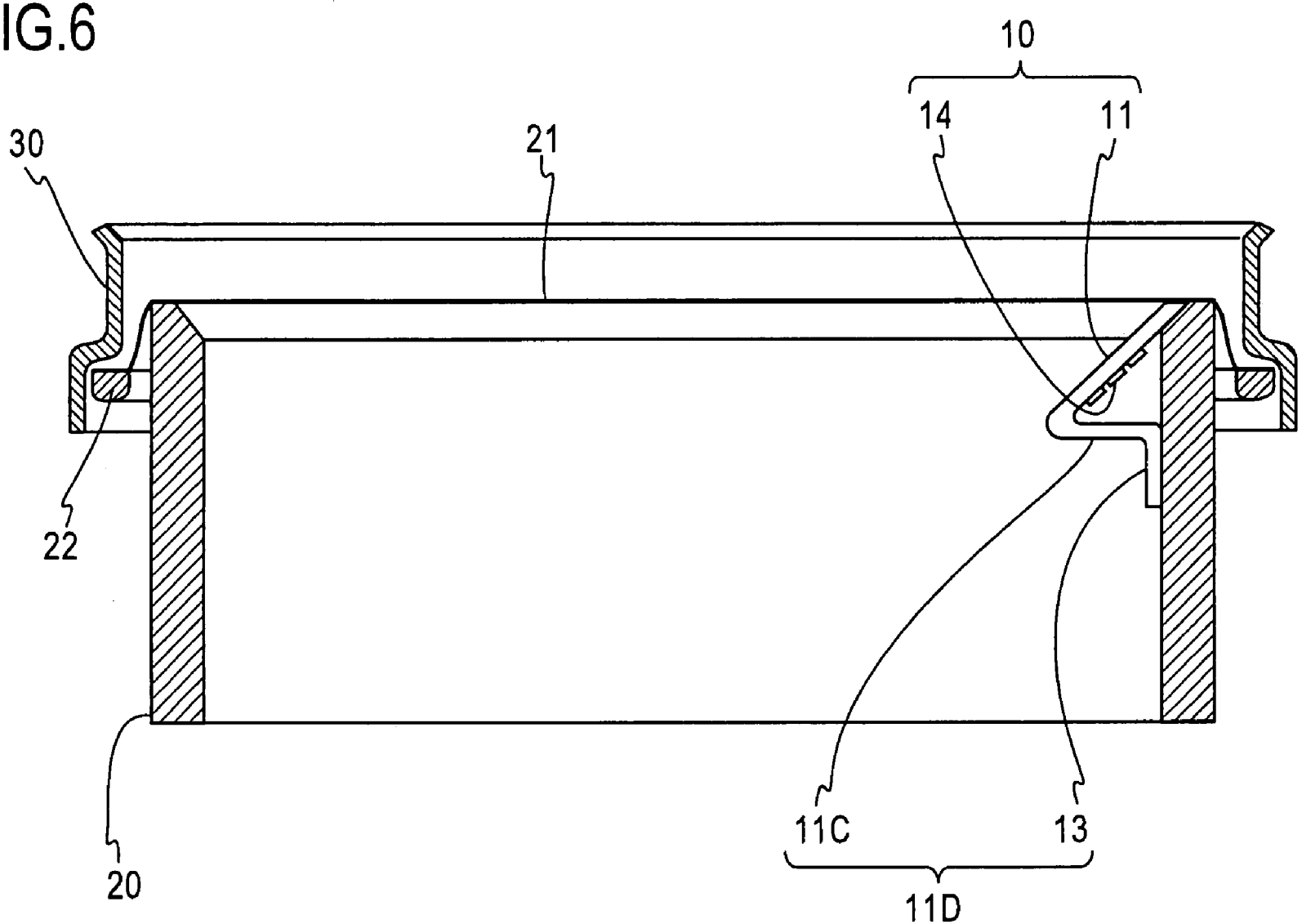
FIG. 6 is a cross-sectional view for illustrating an example of an electric drum composed of a drum and the percussion-instrument pickup shown in FIG. 5 attached thereto.

FIG. 6 shows an example of attachment of the percussion-instrument pickup 10 shown in FIG. 5. The attachment part 13 of the L-shaped supporting part 11D is attached to the inner surface of a body 20 of a drum. The protruding end part 11C of the L-shaped supporting part 11D is supported by the attachment part 13 and protrudes from the inner surface of the body 20 of the drum. The resonance plate 11 is bent back at a predetermined point on the protruding end part 11C at an angle of about 45 degrees, for example, and the tip end of the resonance plate 11 is brought into pressure contact with the attachment surface. In the embodiment shown in FIG. 6, the tip end of the resonance plate 11 is press-fitted into a recess defined by a tapered part formed in the inner perimeter of the open end of the body 20 serving as the attachment surface and a drumhead 21.

Press-fitting of the tip end of the resonance plate 11 brings the tip end into pressure contact with the joint between the backside of the drumhead 21 and the open end of the body 20, so that the tip end is in contact with both the drumhead 21 and the body 20. As a result, the resonance plate 11 is excited by both the drumhead 21 and the body 20, and the vibration pickups 14 attached to the resonance plate 11 can produce drum-sound signals.

With the arrangement shown in FIG. 6, sharp drum sounds can be produced with a shorter attack time ("attack time" refers to the time for sound to rise).

Embodiments in which the percussion-instrument pickups according to the present invention are attached to an acoustic drum have been described above. However, in the following, embodiments of the present invention applied to a muffled drum that minimizes the sound and is suitable for practice will be described.

Fourth Embodiment

Figure 7:
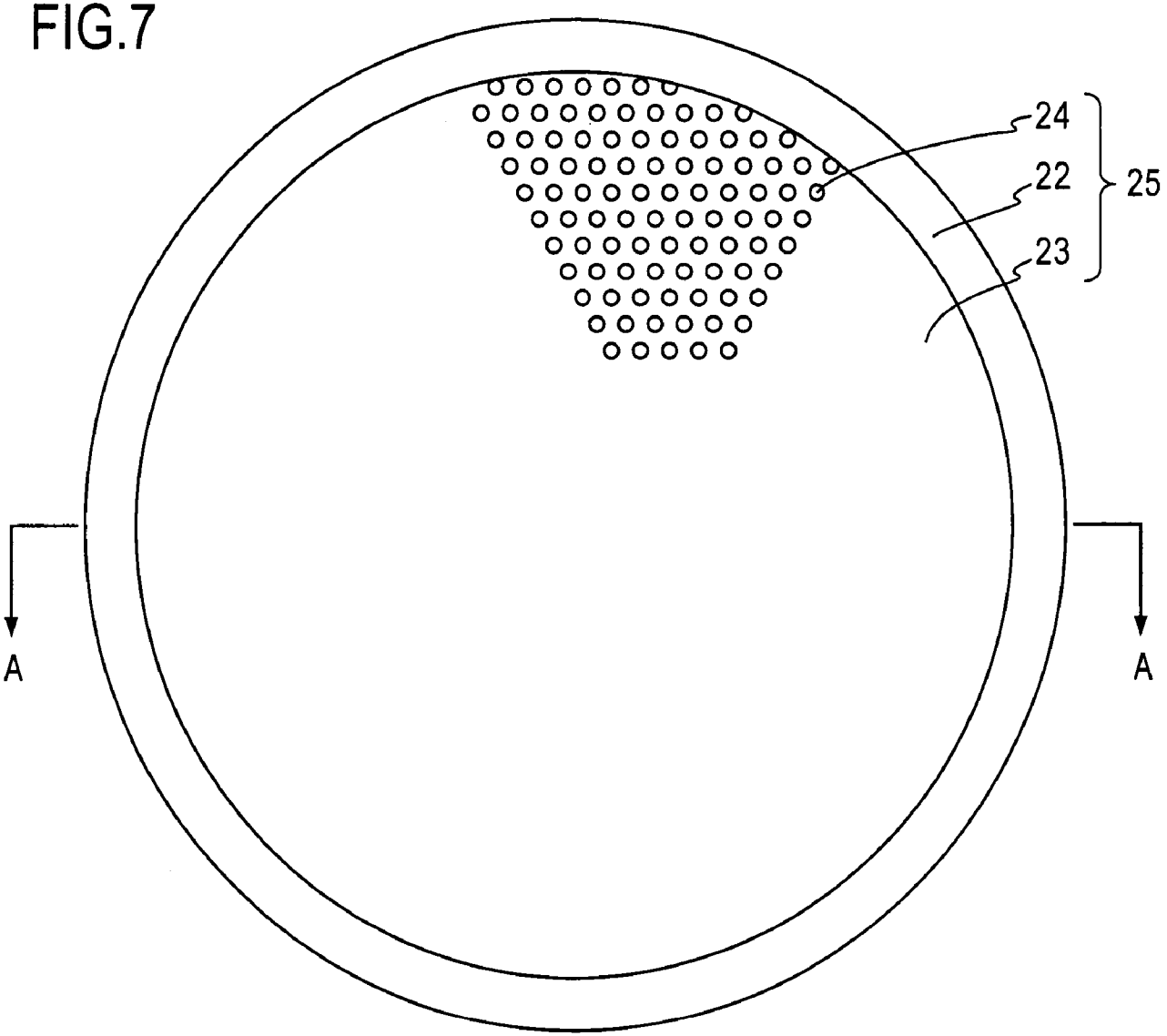
FIG. 7 is a plan view for illustrating a structure of a muffled drumhead used in a muffled drum, which is an example of an electric percussion instrument according to the present invention.
Figure 8:
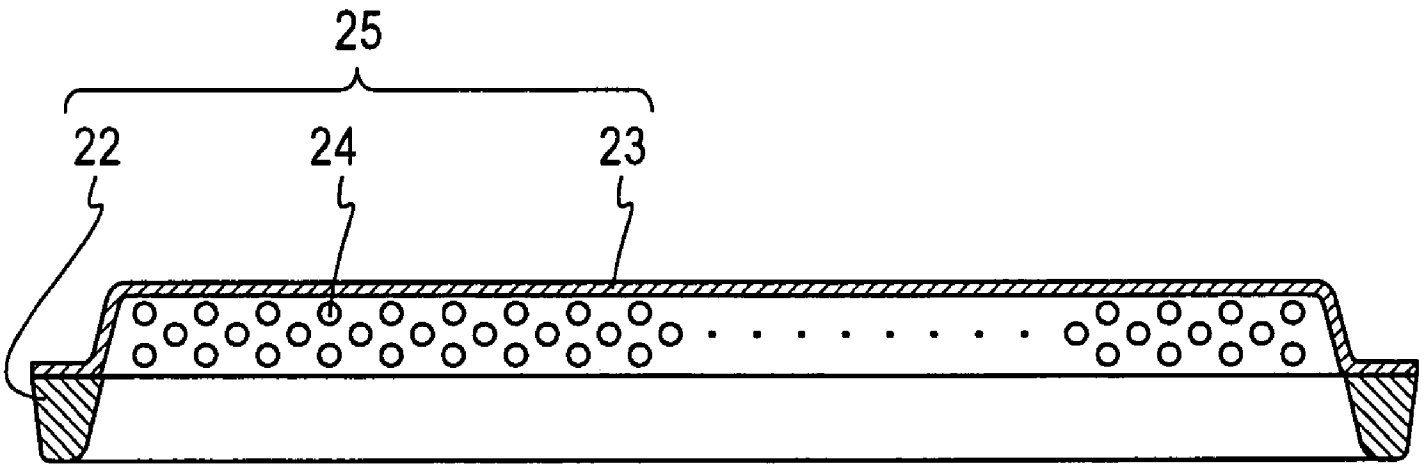
FIG. 8 is a cross-sectional view taken along the line A-A in FIG. 7.

FIGS. 7 and 8 show a muffled drumhead 25 of a muffled drum according to an embodiment of the present invention. The muffled drumhead 25 comprises a perforated polymeric resin film 23 and a ring 22 for holding the perimeter of the perforated polymeric resin film 23.

The perforated polymeric resin film 23 may be a polymeric resin film made of polyethylene terephthalate (PET), polypropylene or the like and having a thickness about 200 μm to 500 μm. Pores 24 formed in the polymeric resin film have a diameter of about 0.5 to 2 mm, for example, and the opening ratio is about 20 to 45%, for example.

Figure 9:
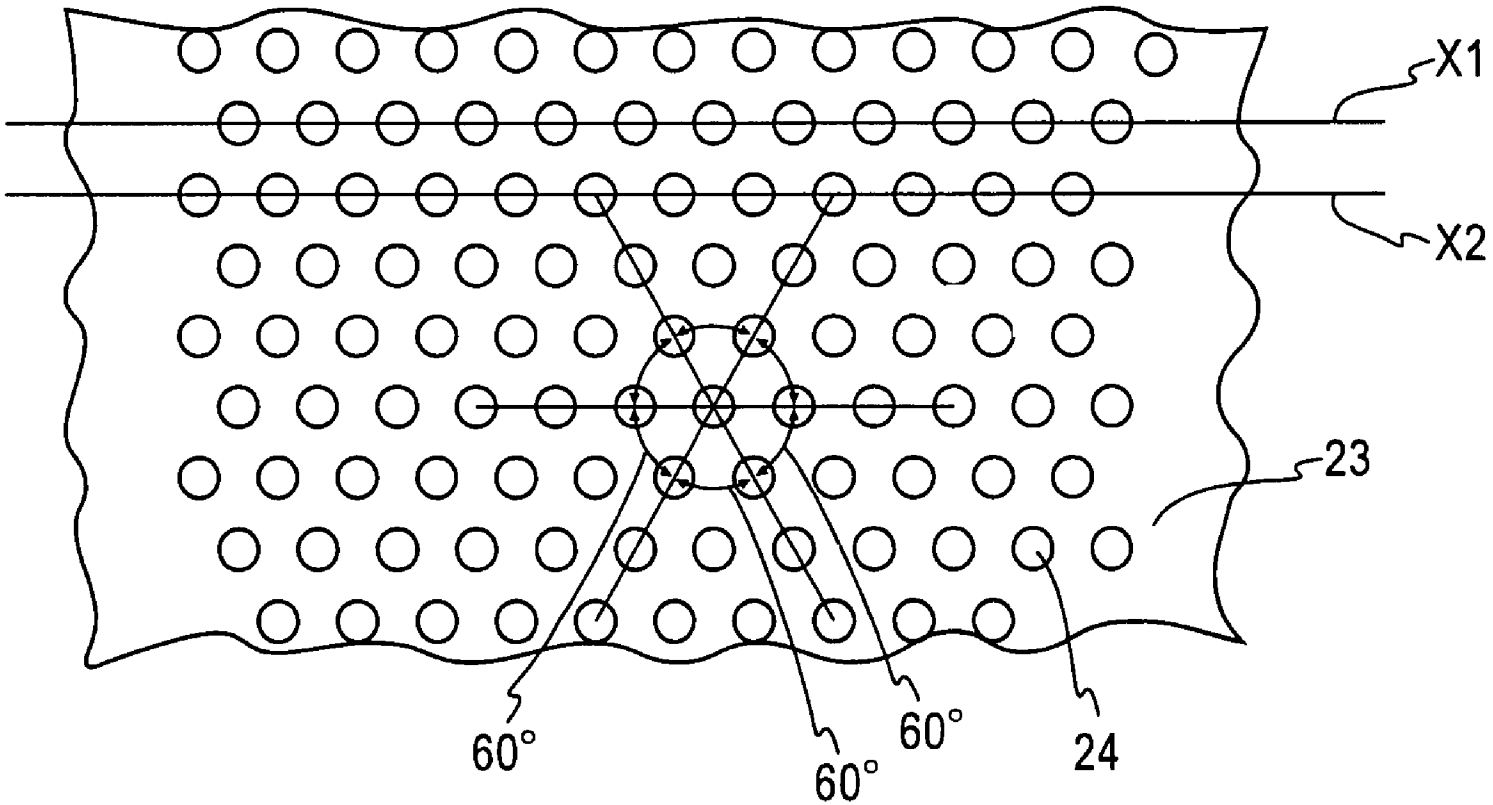
FIG. 9 is an enlarged plan view for illustrating an arrangement of pores formed in a perforated polymeric resin film used for the muffled drumhead shown in FIG. 7.

According to this embodiment, the pores 24 are arranged in a 60-degree staggered pattern. The 60-degree staggered pattern refers to an arrangement pattern in which each pore has six pores around it at intervals of 60 degrees, as shown in FIG. 9. For example, the pores 24 can be formed using a blade capable of forming two rows of pores 24, such as pores 24 along the lines X1 and X2 shown in FIG. 9, by perforating the band-like polymeric resin film while successively displacing the blade along the length of the film or by perforating the band-like polymeric resin film while successively displacing the film at regular intervals.

The 60-degree staggered pattern can make tension equal in every direction. Thus, when the perforated polymeric resin film 23 is stretched over one open end of a body of a drum, the tension applied to the perforated polymeric resin film 23 is equal in 360 degrees. As a result, the tactile impression the drum with the perforated polymeric resin film 23 gives when it is hit is extremely close to that of the acoustic drum. In addition, since the pores 24 have a diameter of about 0.5 to 2.0 mm, there is no possibility that the tip of the stick accidentally get into the pores 24. In addition, since the opening ratio of the pores 24 is about 20 to 45%, sufficient sound attenuation can be achieved.

Fifth Embodiment

Figure 10:
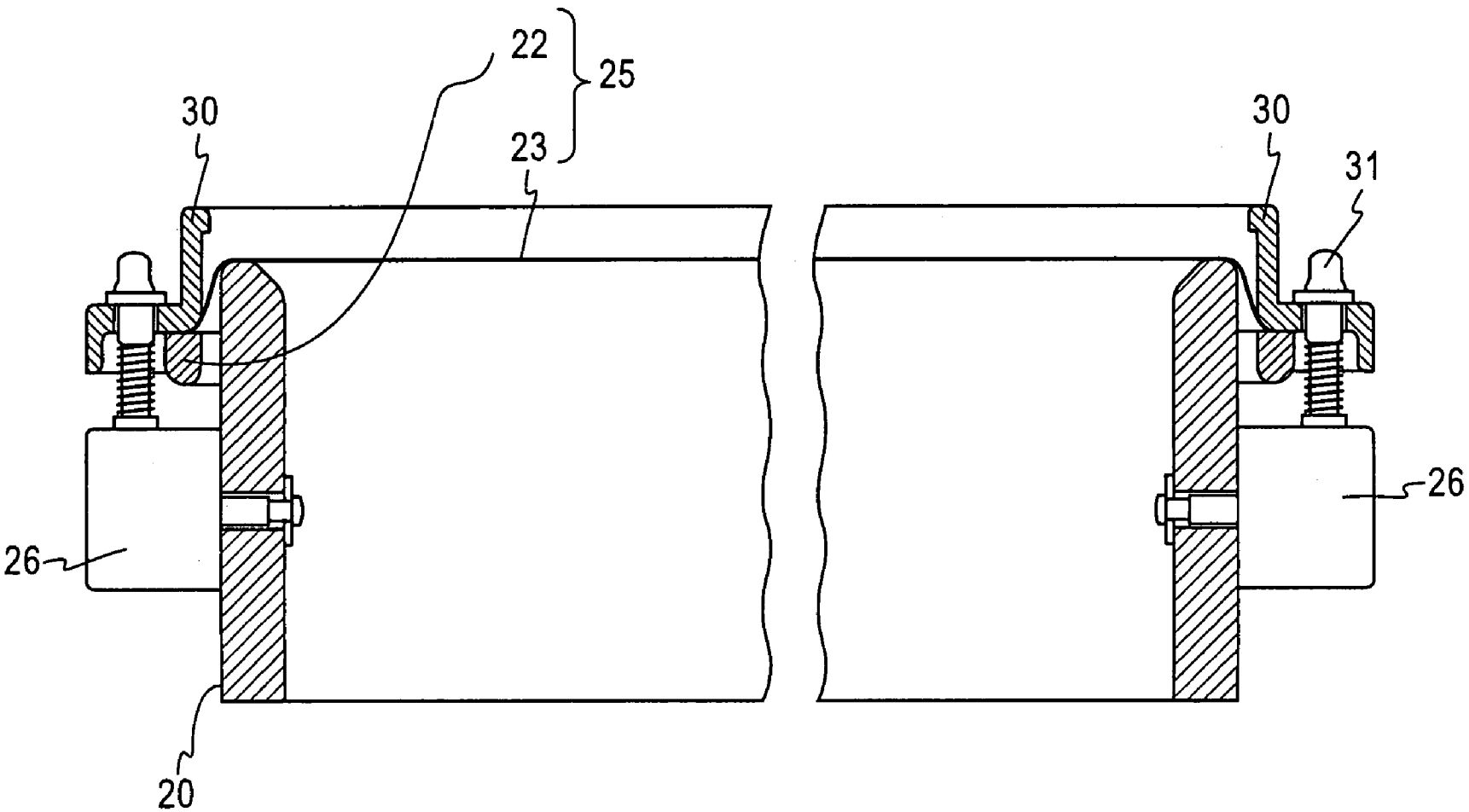
FIG. 10 is a cross-sectional view for illustrating a muffled drum according to an embodiment of the present invention, which has the muffled drumhead shown in FIGS. 7 to 9 attached to the body thereof.

FIG. 10 shows an embodiment in which a muffled drum has a perforated polymeric resin film 23 stretched on the body as a drumhead member. In FIG. 10, reference numeral 20 denotes the cylindrical body, reference numeral 26 denotes a lag attached to the outer surface of the body 20, reference numeral 30 denotes a rim that brings the perforated polymeric resin film 23 into pressure contact with one open end of the body 20 under tension, and reference numeral 31 denotes a tension bolt for producing the pressing force of the rim 30.

If the tension bolt 31 is fitted into the lag 26, the rim 30 is pressed downward, and the ring 22 moves downward as the rim 30 moves. As the ring 22 moves, the perforated polymeric resin film 23 is pressed against one open end of the body 20, and a tensile force is applied in all directions (360 degrees) to the portion of the perforated polymeric resin film 23 inside the open end. Equal outward tensile forces are applied to the perforated polymeric resin film 23. Since the pores 24 are arranged in the 60-degree staggered pattern, the perforated polymeric resin film 23 is pulled in all directions with equal tensile forces.

In addition to the 60-degree staggered pattern, a pattern of pores 24 arranged concentrically about the central axis of the body 20 can provide equal tensile forces in all directions. However, in the case of the concentric arrangement of pores, there is a disadvantage that the cost of jig manufacturing increases, because a plurality of jigs, which comprises cylinders of different diameters each of which has a blade for forming pores 24 at one end thereof, have to be prepared to form the pores concentrically arranged. For this reason, according to the present invention, the 60-degree staggered pattern is preferably used.

The other end of the body 20 of the muffled drum shown in FIG. 10 is open, so that when the muffled drumhead 22 is hit, only a faint sound due to the drumhead hit by the stick is produced. Therefore, if the muffled drum is used, it is possible to practice the drum without annoying those around. In addition, the tactile impression is extremely close to that of the acoustic drum, and therefore, the muffled drum is optimal for practice. Furthermore, if the percussion-instrument pickup shown in any of FIGS. 1, 3 and 5 is attached to the muffled drum with the muffled drumhead 25 shown in FIG. 10, drum-sound signals can be obtained from the muffled drum. From the drum-sound signals, the drum sounds extremely close to the sounds of the acoustic drum can be reproduced even though the muffled drum is actually used.

Sixth Embodiment

Figure 11:
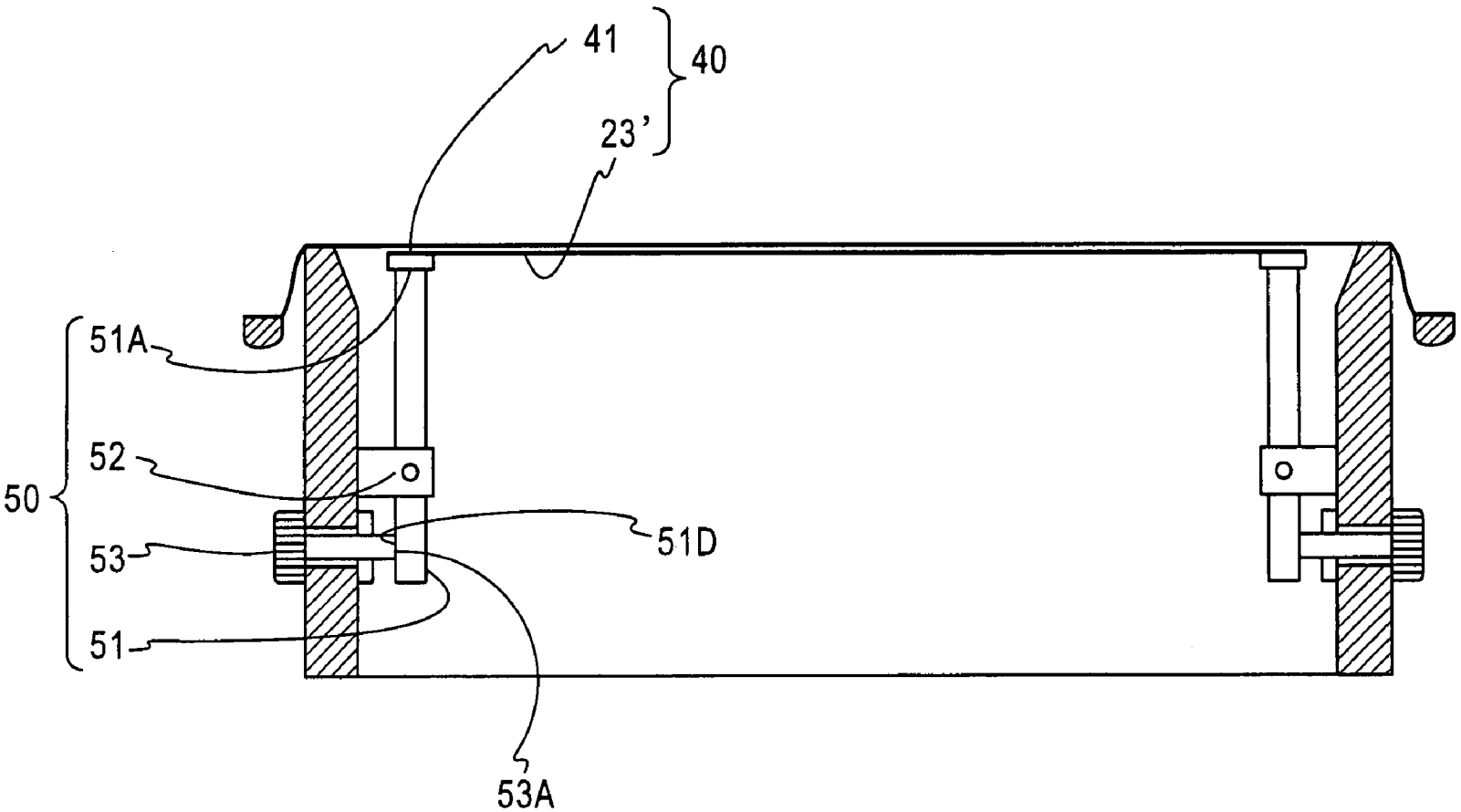
FIG. 11 is a cross-sectional view for illustrating a muffled snare drum according to an embodiment of the present invention, which is the muffled drum shown in FIG. 10 additionally provided with a snappy attached.
Figure 12:
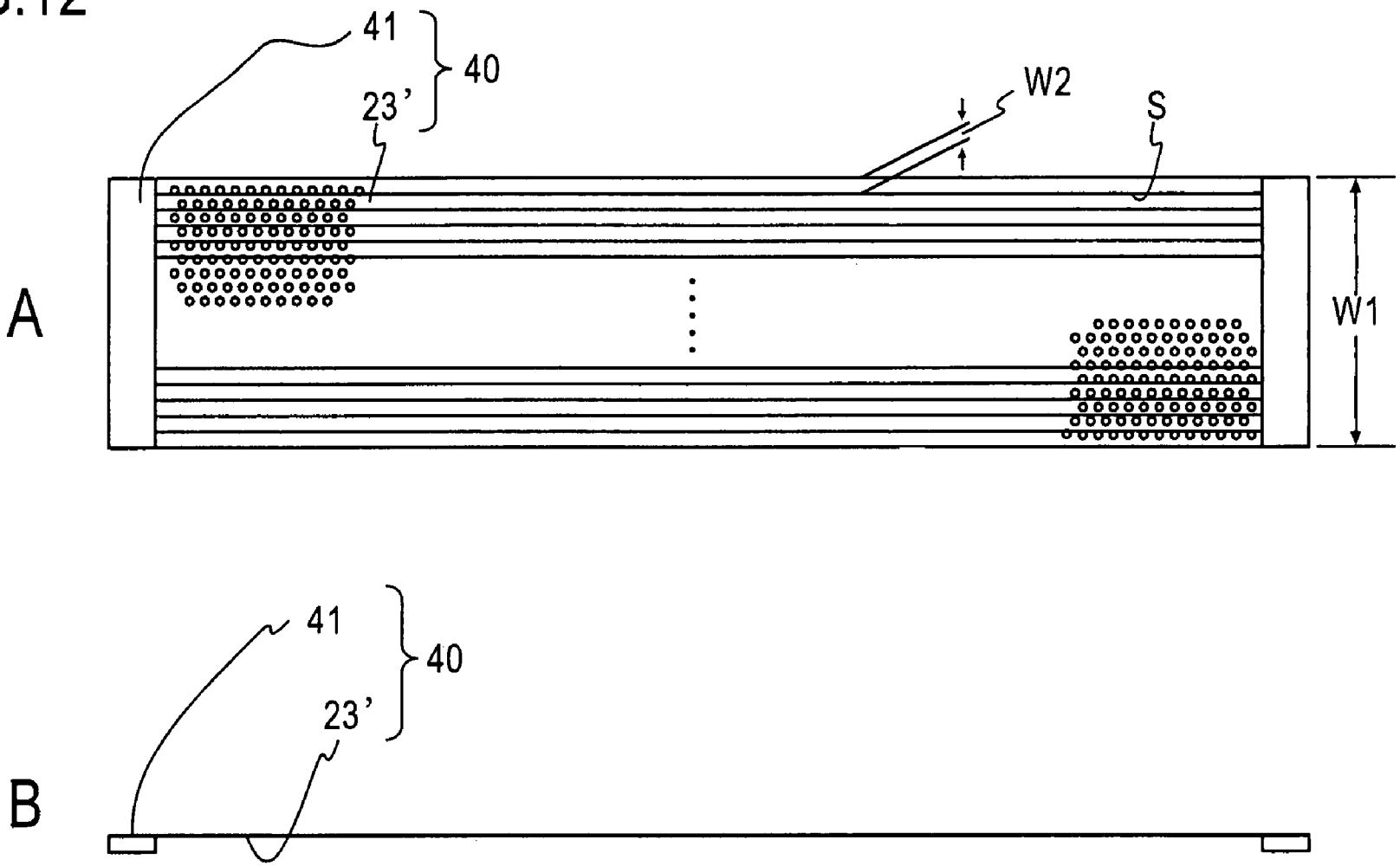
FIG. 12A is a plan view for illustrating the snappy shown in FIG. 11 in detail.
FIG. 12B is a side view for illustrating the snappy shown in FIG. 11 in detail.
Figure 13:
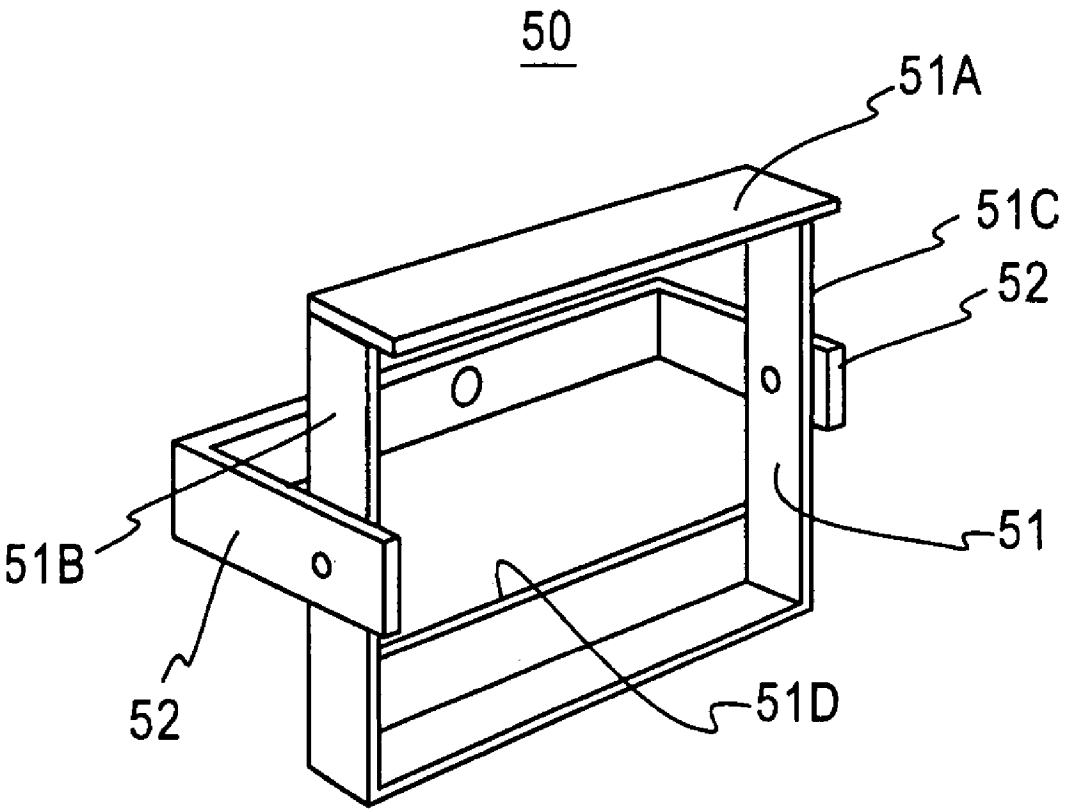
FIG. 13 is a perspective view for illustrating a structure of tension adjusting means used with the snappy shown in FIG. 11.

FIGS. 11 to 13 shows a sixth embodiment of the present invention. According to the sixth embodiment, a snappy is attached to the muffled drum shown in FIG. 10 to make the muffled drum serve as a snare drum with a snappy. In FIG. 11, the elements that are not relevant to the description of this embodiment, such as the rim, are omitted.

In FIGS. 11 and 12, reference numeral 40 denotes a snappy. As shown in FIG. 12A, the snappy 40 can comprise a plurality of perforated polymeric resin film strips 23' formed by dividing the same perforated polymeric resin film 23 as that forming the muffled drumhead 25 into narrow strips and supporting members 41 that support the perforated polymeric resin film strips 23' in parallel with each other.

Alternatively, the perforated polymeric resin film strips 23' need not be separate parts. For example, the supporting members 41 may be attached to the opposite ends of the band-like perforated polymeric resin film 23 as shown in FIG. 11, and parallel lines S be carved in the surface of the perforated polymeric resin film 23 between the supporting members 41, thereby forming parallel perforated polymeric resin film strips 23'. The width W1 of the snappy 40, which depends on the diameter of the muffled drum to which the snappy 40 is to be attached, is approximately 50 to 100 mm. Each of the perforated polymeric resin film strips 23' has a width W2 of about 2 to 4 mm.

The snappy 40 is attached to tension adjusting means 50 via the supporting members 41. The tension adjusting means 50 set the perforated polymeric resin film strips 23' of the snappy 40 close to the backside of the perforated polymeric resin film 23 of the muffled drumhead 25.

FIGS. 11 and 13 shows an example of the tension adjusting means 50. The tension adjusting means 50 shown in these drawings comprises a movable frame 51, a supporting member 52 that pivotally supports two frame sides 51B and 51C of the movable frame 51 (which are two frame sides perpendicular to a side of the movable frame 51 that forms a snappy attachment part 51A) so that the snappy attachment part 51A is in parallel with the backside of the muffled drumhead 25, and an tension adjusting screw 53 that engages with a through hole in the body 20 from the outside to pass therethrough and can be adjusted in height from the inner wall of the body 20 to adjust the position of the pivotally-movable frame 51. A tip end 53A of the tension adjusting screw 53 is in contact with a surface of a beam member 51D perpendicular to the sides 51B and 51C of the movable frame 51. In the example shown in FIGS. 11 and 13, the beam member 51D is located on the opposite side of the point at which the supporting member 52 supports the movable frame 51 to the snappy attachment part 51A. With this arrangement, rotation of the tension adjusting screw 53 changes the height of the tip end 53A of the tension adjusting screw 53 from the inner wall of the body 20, changes the position of the beam member 51D of the movable frame 51 in contact with the tip end 53A, and thus changes the position of the snappy attachment part 51A. By changing the position of the snappy attachment part 51A, the tension exerted on each of the perforated polymeric resin film strips 23' forming the snappy 40 can be adjusted. By adjusting the tension exerted on the perforated polymeric resin film strips 23', the resonance frequency of the perforated polymeric resin film strips 23' can be changed to adjust the quality of the snappy sound.

Since the snappy 40 shown in FIGS. 11 and 12 has the perforated polymeric resin film strips 23' formed by dividing the same perforated polymeric resin film 23 as that of the muffled drumhead 25 into narrow strips, the snappy sound can be sufficiently muffled. In addition, the snappy formed by the perforated polymeric resin film strips 23' can produce a snappy sound that highly resembles the snappy sound of the acoustic drum. Furthermore, if the percussion-instrument pickup shown in any of FIGS. 1, 3 and 5 is attached to the muffled snare drum with the snappy 40, snare-drum-sound signals can be obtained from which sounds extremely resembling the sounds of the acoustic snare drum can be reproduced.

Seventh Embodiment

Figure 14:
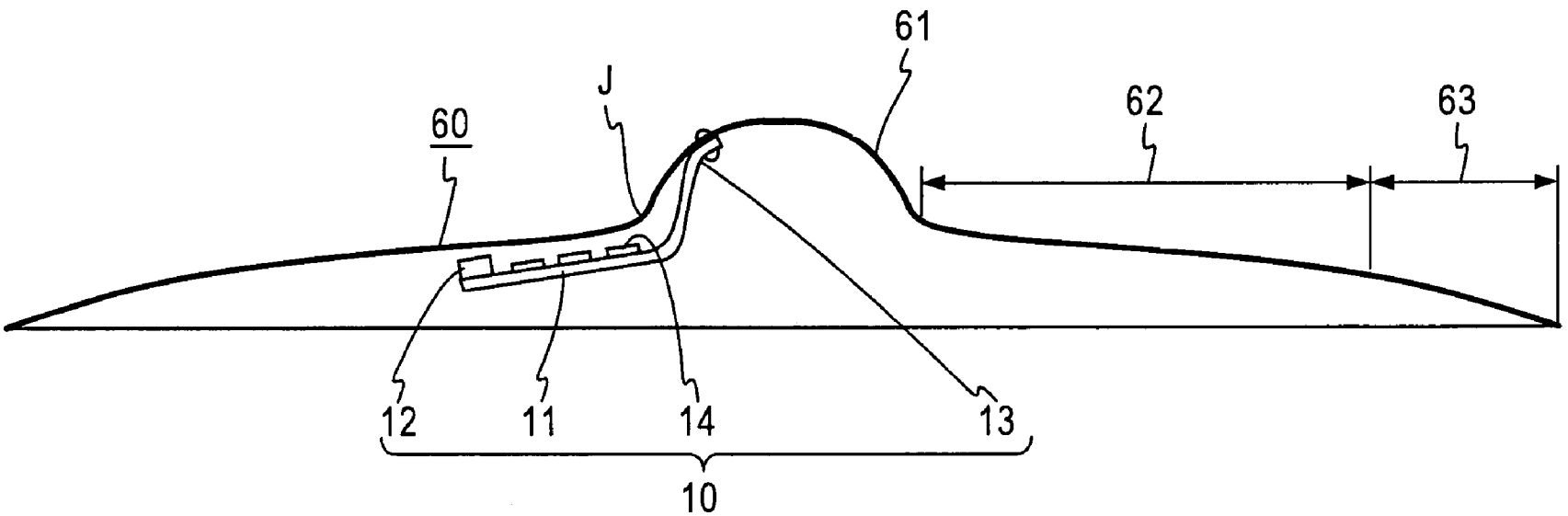
FIG. 14 is a cross-sectional view for illustrating another electric percussion instrument with which a percussion-instrument pickup according to the present invention is used.

FIG. 14 shows an embodiment of the present invention in which a percussion-instrument pickup 10 is used with another percussion instrument. According to the embodiment shown in FIG. 14, the percussion-instrument pickup 10 is used with a cymbal. In this drawing, reference numeral 60 denotes a cymbal. As well known, the cymbal 60 is composed of a disk-like plate of a metal that contains at least copper, such as brass. A semispherical cup 61 is formed at the center of the disk, a bow 62 is formed surrounding the cup 61, and an edge 63 is formed surrounding the bow 62. The boundary between the cup 61 and the bow 62 is referred to as joint J.

Figure 15:
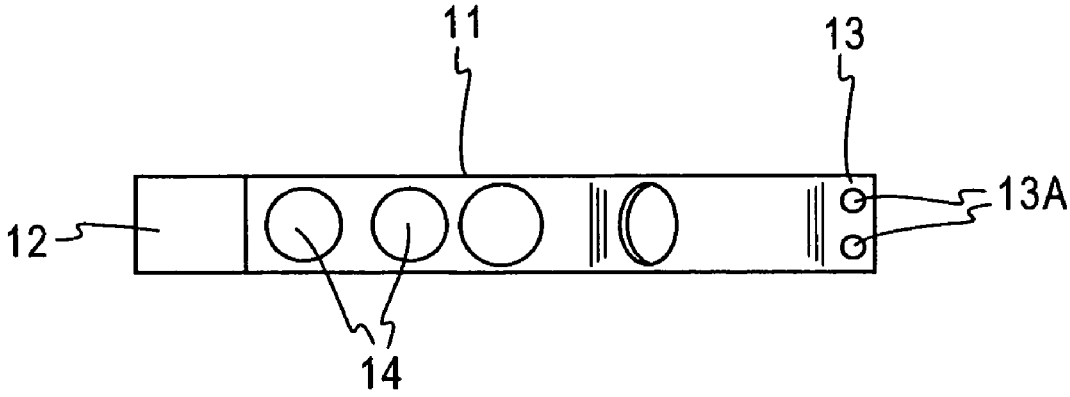
FIG. 15 is a plan view for illustrating a percussion-instrument pickup according to an embodiment of the present invention used with the percussion instrument shown in FIG. 14.
Figure 16:
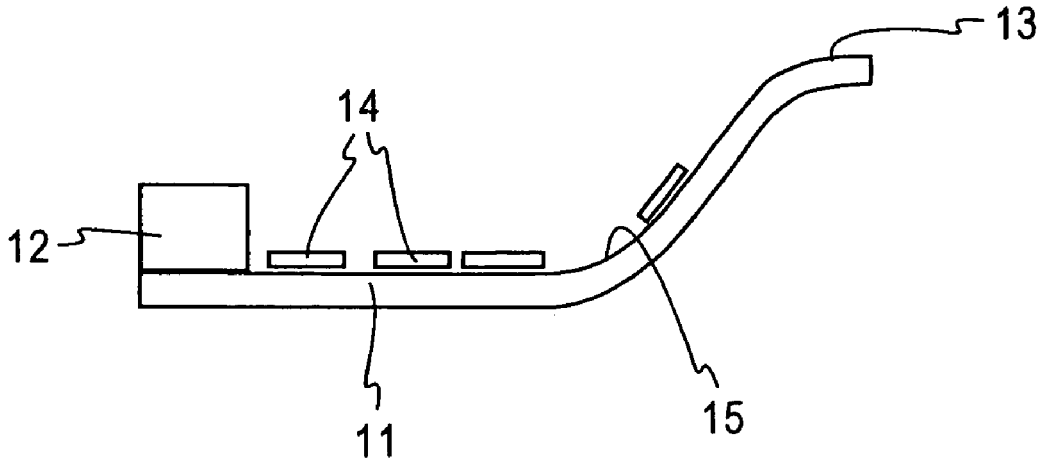
FIG. 16 is a side view of the percussion-instrument pickup shown in FIG. 15.

FIGS. 15 and 16 show the percussion-instrument pickup 10 used with the cymbal 60. In the case where the percussion pickup 10 is used with the cymbal 60, although a weight 12 and vibration pickups 14 are provided in the same manner as with the percussion-instrument pickup shown in FIG. 1, the structure of an attachment part 13 slightly differs from that of the percussion-instrument pickup shown in FIG. 1.

As in the embodiment shown in FIG. 1, a resonance plate 11 is rectangular in this embodiment. The attachment part 13, which has a curve conforming to the curve of the backside of the cup 61, is formed at one end of the resonance plate 11. The attachment part 13 has a screw hole 13A, and the attachment part 13 is attached to the backside of the cup 61 with a screw, a rivet or the like passing through the screw hole 13A. Alternatively, the attachment part 13 may be welded or otherwise attached to the backside of the cup 61.

In order that the resonance plate 11 does not come into contact with the joint J between the cup 61 and the bow 62, a curved part 15 is formed between the attachment part 13 and the other end of the resonance plate 11 (see FIG. 16). Thus, the resonance plate is in contact with the cymbal 60 only at the attachment part 13. Thus, the resonance plate 11 is supported on the backside of the cup 61 in a cantilever configuration.

The resonance plate 11 is made of a metal similar to the material of the cymbal that contains at least copper, such as brass. In addition, the weight 12 is preferably made of similar materials. If the weight 12 and the resonance plate 11 are both made of a metal containing copper in this way, the deep tones specific to a coppery cymbal can be reproduced from the resonant-vibration detection signals output from the vibration pickups 14 applied to the surface of the resonance plate 11 between the weight 12 and the attachment part 13.

The cymbal 60 shown in FIG. 14 is an acoustic cymbal. Therefore, the cymbal 60 produces a loud sound when it is hit. In addition, however, according to this embodiment, the percussion-instrument pickup 10 produces electric signals, and cymbal sounds can be reproduced from the electric signals and amplified by a loudspeaker device. This feature makes the cymbal 60 suitable for use in great halls.

Eighth Embodiment

Figure 17:
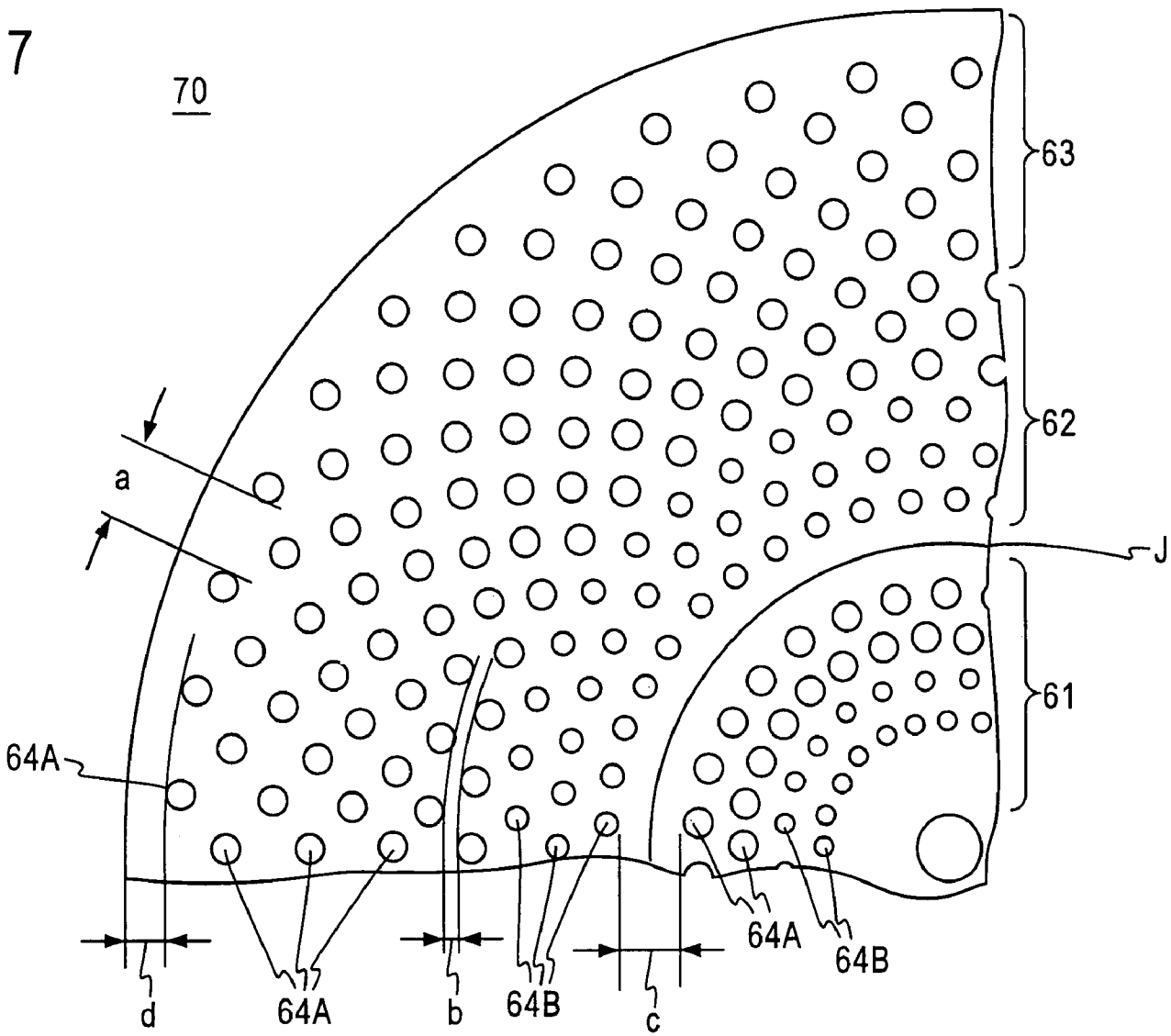
FIG. 17 is an enlarged plan view of a part of another electric percussion instrument with which a percussion-instrument pickup according to the present invention is used.

FIG. 17 shows another example a percussion instrument with which a percussion-instrument pickup according to the present invention can be used. This embodiment concerns to a muffled cymbal 70, which is an acoustic cymbal that has multiple pores 64A, 64B formed therein to achieve sound attenuation.

The pores 64A and 64B have diameters ranging from about 2.5 mm to about 4 mm. In the example shown in FIG. 17, larger pores 64A are formed in an edge 63, a part of a bow 62 and an outer part of a cup 61, and smaller pores 64B are formed in an inner part of the bow 62 and an inner part of the cup 61.

If the pores 64A and 64B have a too small diameter, the sound attenuation capability is compromised. If the pores 64A and 64B have a too large diameter, the tip of the stick is likely to accidentally get into the pores, disturbing the performance. Therefore, the appropriate upper limit of the diameter of the pores is about 4 mm. The pores 64A and 64B are preferably circumferentially arranged with a pitch "a" equal to or larger than their respective diameters. However, if the pitch "a" is too large, the sound attenuation capability is compromised. Therefore, the pitch "a" is preferably equal to or less than three times the diameter of the pores 64A and 64B.

On the other hand, the radial interval "b" between the concentrically arranged pores 64A and 64B is preferably small, because the number of pores 64A and 64B decreases as the interval "b" becomes smaller. However, if the interval "b" is too small, the muffled cymbal 70 cannot have a sufficient mechanical strength. Therefore, the pores are preferably formed in a staggered arrangement. This allows the interval "b" to be reduced without reducing the mechanical strength of the muffled cymbal 70. In addition, if the pores 64A and 64B are formed in the vicinity of the outer perimeter of the edge 63, the crash sound produced when the edge 63 is hit is too small. Thus, an area "d" including no pores that has a width of about 8 to 10 mm is preferably formed along the outer perimeter of the edge 63 (see FIG. 17). In addition, the circumferential pitch of the pores 64A and 64B concentrically arranged preferably increases with distance from the center thereof as shown in FIG. 17. With such a configuration, a natural change in tone depending on the hitting point can be attained as with ordinary cymbals.

There is a joint J between the protruding cup 61 and the bow 62. The presence of the joint J allows a clear sound containing treble components to be produced when the cup 61 is hit. To produce such a sound, the joint J and areas in the vicinity thereof preferably include no pores. In the example shown in FIG. 17, pores 64A and 64B are not formed over a distance "c" of about 5 to 10 mm. Furthermore, the pores 64A and 64B can have a circular shape, a rectangular shape, a cross shape or the like.

If the muffled cymbal 70 is configured as shown in FIG. 17, the multiple pores 64A and 64B absorb the hitting energy and prevent the resonance of the cymbal. As a result, when the muffled cymbal 70 is hit, the hitting sound is suppressed, and accordingly the sound produced becomes smaller. However, even though the sound produced is small, the tones specific to the cup 61, the bow 62 and the edge 63 can be produced by hitting the respective parts, and the sound can change depending on the type of the stick, so that the muffled cymbal 70 is suitable for practice. Besides the sound attenuation capability, it is confirmed that because the vibrations are reflected by the pores 64A and 64B in the course of transfer of the vibrations, the frequency components of the vibrations are dispersed, the vibration energy is attenuated, and harmonic components increases.

As described above, since harmonic components increases, there is provided an advantage that the tone of the sound of the cymbal is improved. That is, cymbal sounds that are small but rich in tone can be produced.

The percussion-instrument pickup 10 shown in FIGS. 15 and 16 can be attached to the muffled cymbal 70 shown in FIG. 17. Here, since the percussion-instrument pickup 10 according to the present invention has the weight 12 attached to the resonance plate 11, the resonance frequency of the resonance plate 11 can be set at an appropriate frequency. That is, even if the attachment part 13 of the resonance plate 11 is attached to the cup of the muffled cymbal 70, the resonance plate 11 resonates at a resonance frequency determined by the weight of the weight 12, the distance between the attachment part 13 and the weight 12, the thickness (elastic modulus) of the resonance plate 11 and the like. By appropriately setting the resonance frequency, the frequency components of the electric vibrations produced by the vibration pickups 14 can be made close to the whole frequency components of the sound of the acoustic cymbal, not only to the frequency components of the sound produced from the cup 61.

Thus, if resonance plates 11 are prepared that have different resonance frequencies because of the different weights of weights 12, the different shapes of the resonance plates 11 or the like, there can be provided electric cymbals that produce different cymbal-sound signals containing different frequency components depending on the resonance frequency. That is, if resonance plates 11 having different resonance frequencies are attached to muffled cymbals having an equal diameter, there can be provided electric cymbals that produce cymbal-sound signals from which different tones can be reproduced depending on the resonance frequency of the resonance plates 11.

In addition, the resonance plate 11 attached to the cup 61 resonates at its own resonance frequency, and the resonance energy is accumulated in the resonance plate 11. The accumulated resonance energy excites the cup 61 of the muffled cymbal 70 when the vibration of the muffled cymbal 70 attenuates, and thus, the reverberation time of the muffled cymbal is extended slightly. This phenomenon is advantageous for the muffled cymbal 70, which has a reduced reverberation time because the pores 64A and 64B are formed.

Although a simple cymbal and a muffled cymbal have been described above, the percussion-instrument pickup according to the present invention can be used with so-called high-hat cymbals, which are composed of two cymbals stacked on one another, the upper one being moved with a foot pedal to make a sound. In this case, the percussion-instrument pickup is preferably attached to each of the cymbals.

Ninth Embodiment

Figure 18:
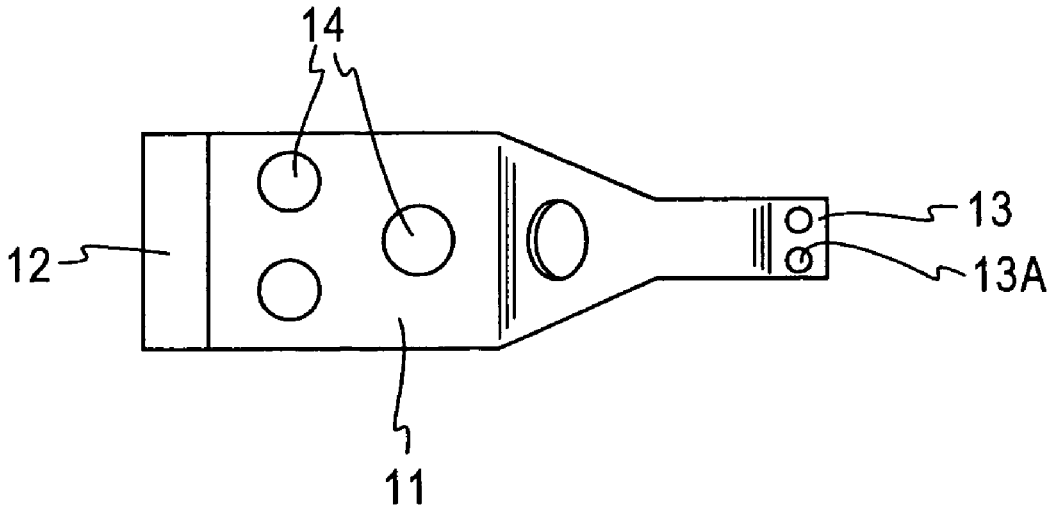
FIG. 18 is a plan view for illustrating a modification of the percussion-instrument pickup shown in FIGS. 15 and 16.
Figure 19:
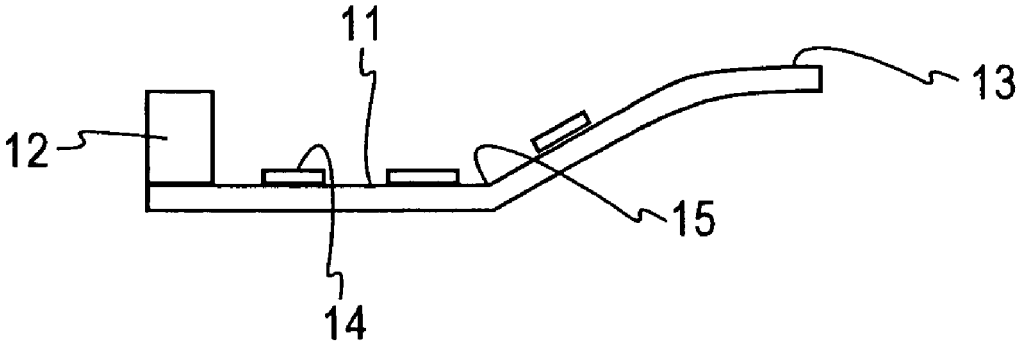
FIG. 19 is a side view of the percussion-instrument pickup shown in FIG. 18.

FIGS. 18 and 19 show a resonance plate 11 according to a modified embodiment. According to this embodiment, the resonance plate 11 has a wide resonance part and a narrow attachment part 13. With such a configuration, the resonance frequency of the wide part of the resonance plate 11 can be lowered without increasing the weight of the weight 12. In addition, since the entire length of the resonance plate 11 can be reduced, the resonance plate 11 having a lower resonance frequency can be downsized. In addition, if notches similar to those shown in FIG. 3 are formed in the resonance plate 11 shown in FIGS. 18 and 19, the resonance frequency of the resonance frequency 11 can be equal to that of a long one, or the resonance plate 11 can have a plurality of resonance frequencies. Thus, the resonance plate 11 can be provided that can produce a wide variety of resonance spectra.

As described above, according to the present invention, a drum sound or a cymbal sound similar to the sound of the acoustic drum or acoustic cymbal can be output from a loudspeaker device. Therefore, the percussion-instrument pickup according to the present invention and the electric percussion instrument provided therewith can be widely used for practice and a concert, for example.

What is claimed is:

1. A percussion-instrument pickup, comprising:

a resonance plate that is made of a metal containing at least copper and has an area smaller than the area of a hitting surface of a percussion instrument to which the percussion-instrument pickup is attached;

a weight part attached to a part of the perimeter of the resonance plate, said weight part having a volume of material separate from said resonance plate;

an attachment part disposed at a predetermined distance from the point of attachment of the weight part; and a plurality of vibration pickups attached to the surface of said resonance plate between said attachment part and said weight part;

wherein:

said attachment part is configured to be attached to an inner wall of a body supporting said hitting surface of said percussion instrument, said resonance plate is configured to be attached to said inner wall of said body via said attachment part in a cantilever configuration, to be disposed inside said hitting surface, to be excited by a vibration of said body, said weight part is configured to be disposed inside said hitting surface and spaced apart therefrom when said resonance plate is attached to said inner wall of said body via said attachment part in the cantilever configuration, said vibration pickups are configured to be disposed inside said hitting surface and spaced apart therefrom when said resonance plate is attached to said inner wall of said body via said attachment part in the cantilever configuration, to produce sound signals from resonance of said resonance plate, a resonance frequency of said resonance plate depends on a weight of said weight part.

2. The percussion-instrument pickup according to claim 1, wherein said hitting surface is substantially circular in shape, said resonance plate has a substantially rectangular shape, the longer side thereof being shorter than the diameter of the hitting surface of the percussion instrument to which the percussion-instrument pickup is attached, the weight part being attached to one of the shorter sides thereof, and the attachment part being disposed at the other shorter side, and the plurality of vibration pickups are attached to the surface of said resonance plate between the attachment part and the point of attachment of the weight part.

3. The percussion-instrument pickup according to claim 1, wherein said resonance plate has one or more notches formed in an edge thereof, the one or more notches divide said resonance plate into a plurality of resonance elements, and each of the plurality of resonance elements has a vibration pickup attached thereto.

4. The percussion-instrument pickup according to claim 2, wherein said resonance plate has one or more notches formed in an edge thereof, the one or more notches divide said resonance plate into a plurality of resonance elements, and each of the plurality of resonance elements has a vibration pickup attached thereto.

5. An electric percussion instrument that comprises cylindrical body and a drumhead attached over an open end of the cylindrical body and produces a drum sound when the drumhead is hit, wherein the electric percussion instrument further comprises a percussion-instrument pickup that has a resonance plate that is made of a metal containing at least copper and has an area smaller than that of said drumhead, a weight part attached to a part of the perimeter of the resonance plate, said weight part having a volume of material separate from said resonance plate, an attachment part disposed at a predetermined distance from the point of attachment of the weight part, and a plurality of vibration pickups attached to the surface of said resonance plate between said attachment part and said weight part, and said resonance plate of said percussion-instrument pickup is attached to the inner wall of said body via said attachment part in a cantilever configuration, said resonance plate is disposed inside said drumhead, said weight part and said vibration pickups disposed inside said drumhead and spaced apart therefrom, said resonance plate supported in the cantilever configuration is excited by a vibration of said body, a resonance frequency of said resonance plate depends on a weight of said weight part, and said vibration pickups attached to said resonance plate produce drum-sound signals from the resonance of said resonance plate.

6. The electric percussion instrument according to claim 5, wherein said resonance plate has a substantially rectangular shape, the longer side thereof being shorter than the diameter of the drumhead, the weight part being attached to one of the shorter sides thereof, and the attachment part being disposed at the other shorter side, and the plurality of vibration pickups are attached to the surface of said resonance plate between the attachment part and the point of attachment of the weight part.

7. The electric percussion instrument according to claim 5, wherein said resonance plate has one or more notches formed in an edge thereof, the one or more notches divide said resonance plate into a plurality of resonance elements, and each of the plurality of resonance elements has a vibration pickup attached thereto.

8. The electric percussion instrument according to claim 6, wherein said resonance plate has one or more notches formed in an edge thereof, the one or more notches divide said resonance plate into a plurality of resonance elements, and each of the plurality of resonance elements has a vibration pickup attached thereto.

9. The electric percussion instrument according to claim 5, wherein a part of said resonance plate of said percussion-instrument pickup is in contact with said drumhead in the vicinity of the joint between said drumhead and said body, and said resonance plate is supplied with excitation energy from both said body and said drumhead.

10. The electric percussion instrument according to claim 5, wherein said drumhead is composed of a perforated polymeric resin film that has pores formed therein with an opening ratio of about 20 to 45%.

11. The electric percussion instrument according to claim 10, wherein said pores formed in said drumhead are arranged in a 60-degree staggered pattern.

12. An electric percussion instrument, comprising:

a cymbal that is composed of a disk-like metal plate and has a protruding cup at the center thereof, a bow surrounding the cup, and an edge surrounding the bow; and a percussion-instrument pickup that has a resonance plate that is made of a metal containing at least copper and has an area smaller than the area of said cymbal, a weight part attached to a part of the perimeter of the resonance plate, said weight part having a volume of material separate from said resonance plate, an attachment part disposed at a predetermined distance from the point of attachment of the weight part, and a plurality of vibration pickups attached to the surface of said resonance plate between said attachment part and said weight part, wherein said attachment part of said resonance plate of said percussion-instrument pickup is attached to the backside of said cup, said resonance plate is attached to the backside of said cup via said attachment part in a cantilever configuration, said resonance plate is disposed inside said bow, said weight part and said vibration pickups disposed inside said bow and spaced apart therefrom, the resonance plate of said percussion-instrument pickup is excited by a vibration of said cup, a resonance frequency of said resonance plate depends on a weight of said weight part, and said vibration pickups produce electric signals having a waveform corresponding to the sound of the cymbal.

13. The electric percussion instrument according to claim 12, wherein said resonance plate has a substantially rectangular shape, the longer side thereof being shorter than the diameter of the hitting surface or a percussion instrument to which the percussion-instrument pickup is attached, the weight part being attached to one of the shorter sides thereof, and the attachment part being disposed at the other shorter side, and the plurality of vibration pickups are attached to the surface of said resonance plate between the attachment part and the point of attachment of the weight part.

14. The electric percussion instrument according to claim 12, wherein said resonance plate has one or more notches formed in an edge thereof, the one or more notches divide said resonance plate into a plurality of resonance elements, and each of the plurality of resonance elements has a vibration pickup attached thereto.

15. The electric percussion instrument according to claim 13, wherein said resonance plate has one or more notches formed in an edge thereof, the one or more notches divide said resonance plate into a plurality of resonance elements, and each or the plurality of resonance elements has a vibration pickup attached thereto.

16. The electric percussion instrument according to claim 12, wherein multiple pores are formed in the bow and edge of said cymbal.

* * * * *